US008212868B2

(12) United States Patent
High

(10) Patent No.: US 8,212,868 B2
(45) Date of Patent: Jul. 3, 2012

(54) FULL IMAGE JEWELRY POSITIONER

(75) Inventor: Jeffrey L. High, Davenport, IA (US)

(73) Assignee: Gemvision Corporation, L.L.C., Davenport, IA (US)

( * ) Notice: Subject to any disclaimer, the term of this patent is extended or adjusted under 35 U.S.C. 154(b) by 1497 days.

(21) Appl. No.: 11/729,283

(22) Filed: Mar. 28, 2007

(65) Prior Publication Data

US 2007/0251903 A1 Nov. 1, 2007

Related U.S. Application Data

(60) Provisional application No. 60/787,285, filed on Mar. 30, 2006.

(51) Int. Cl.
*H04N 9/47* (2006.01)
*H04N 13/04* (2006.01)

(52) U.S. Cl. ..... 348/94; 348/61; 348/95; 356/135; 211/85.17

(58) Field of Classification Search ..... None
See application file for complete search history.

(56) References Cited

U.S. PATENT DOCUMENTS 3,790,287 A * 2/1974 Cuthbert et al. ..... 356/446
3,870,880 A * 3/1975 Merigoux et al. ..... 378/81
4,391,520 A * 7/1983 Ziegel ..... 356/154
4,463,856 A * 8/1984 Strasser ..... 211/163
4,710,259 A * 12/1987 Howe et al. ..... 117/15
5,811,817 A * 9/1998 Ravich ..... 250/372
5,839,424 A * 11/1998 Hauser ..... 125/16.02
6,147,750 A * 11/2000 Johansson et al. ..... 356/71
6,229,564 B1 * 5/2001 High ..... 348/94
6,348,964 B1 * 2/2002 Wagner et al. ..... 356/30
7,942,276 B2 * 5/2011 Johnson et al. ..... 211/1.53
2005/0098510 A1 * 5/2005 Lom et al. ..... 211/13.1
2007/0251903 A1 * 11/2007 High ..... 211/85.2
2009/0176034 A1 * 7/2009 Ruuttu et al. ..... 427/566

* cited by examiner

*Primary Examiner* — David England
(74) *Attorney, Agent, or Firm* — Hamilton IP Law, PC.; Jay R. Hamilton; Charles A. Damschen

(57) ABSTRACT

A jewelry fixture having a mounting pedestal cooperatively engaged with the top side of a base is disclosed. First and second angled surface are cooperatively positioned on the top side of the base. The angled surfaces have a reflective or mirrored surface. The angled surfaces are positioned adjacent and perpendicular to each other. A jewelry holder allowing cooperative engagement with an item of jewelry is positioned between the angled surfaces and cooperatively engaged with the mounting pedestal on the top side of the base. The base has reference and prime positioning guides. The full-image jewelry positioner (fixture) improves the development of images for duplication or replication of jewelry or other items having detailed structures. When combined with a camera or a camera and a computer system, the images developed may be captured and manipulated for auto-tracing and duplication or replication of the item of jewelry.

8 Claims, 6 Drawing Sheets

FULL IMAGE JEWELRY POSITIONER

CROSS REFERENCE TO RELATED APPLICATIONS

This non-provisional patent application claims priority from and incorporates in its entirety the contents of the provisional patent application previously filed on Mar. 30, 2006 and assigned Ser. No. 60/787,285 by the United States Patent & Trademark Office.

FIELD OF THE INVENTION

The present invention relates to a method and apparatus to allow positioning of jewelry for increased perspective image development. The jewelry fixture may be used in combination with a camera for full perspective image capture. The jewelry fixture may also be used in combination with a digital camera and a computer system to allow manipulation of the captured images.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)(c)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

DETAILED DESCRIPTION

Listing of Elements

Figure 1:
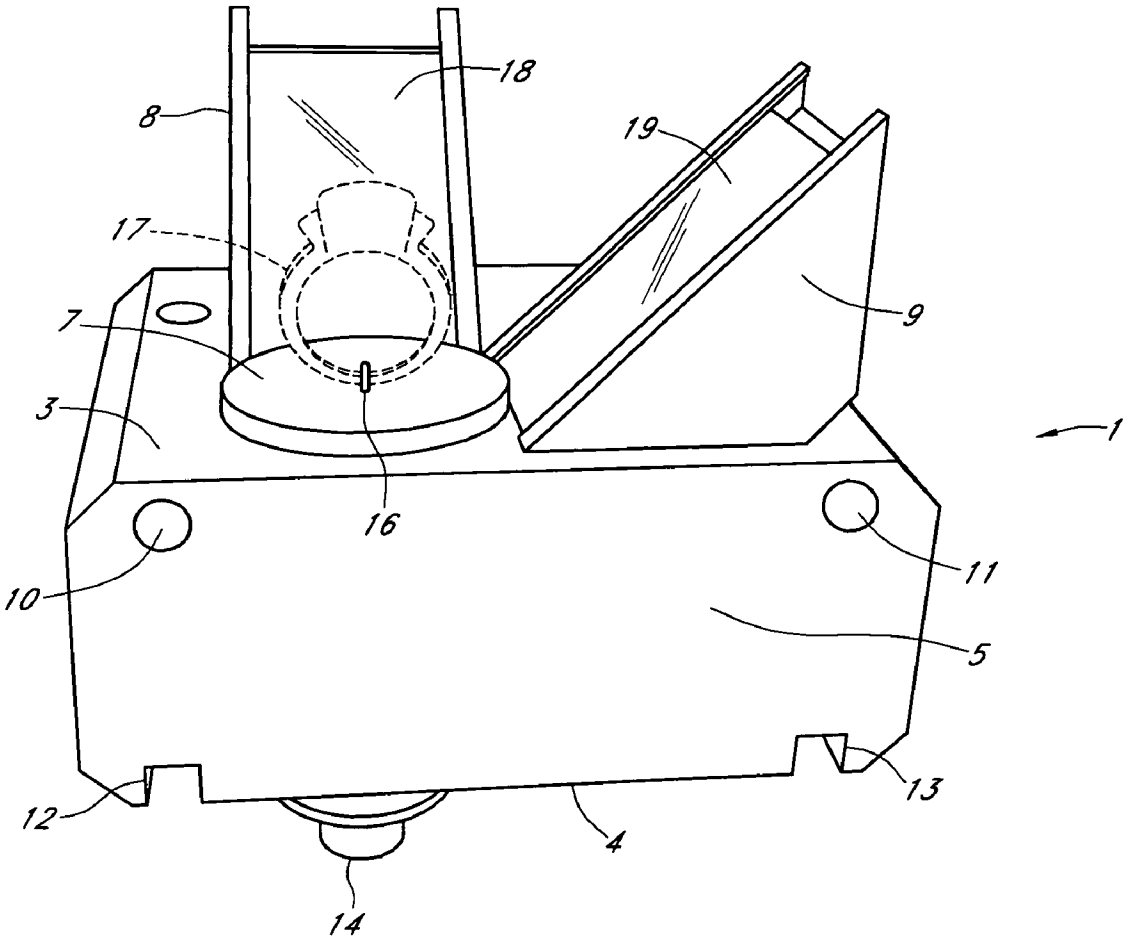
FIG. 1 is a front perspective view of the jewelry fixture.

| Element Description | Element Number |
|---|---|
| Full Image Jewelry Positioner (fixture) | 1 |
| Base | 2 |
| Base—Top Side | 3 |
| Base—Bottom Side | 4 |
| Base—Front Side | 5 |
| Base—Back side | 6 |
| Mounting Pedestal | 7 |
| First ($1^{st}$) Angled Surface Support | 8 |
| Second ($2^{nd}$) Angled Surface Support | 9 |
| First ($1^{st}$) Reference Positioning Guide | 10 |
| Second ($2^{nd}$) Reference Positioning Guide | 11 |
| First ($1^{st}$) Prime Positioning Guide | 12 |
| Second ($2^{nd}$) Prime Positioning Guide | 13 |
| Supporting Cylinder | 14 |
| Supporting Cylinder Tube | 15 |
| Retractable Jewelry Holder | 16 |
| Item of Jewelry (Ring) | 17 |
| First ($1^{st}$) Reflective (mirrored) Surface | 18 |
| Second (2nd) Reflective (mirrored) Surface | 19 |
| Fixture Support Rods | 20 |
| Top View Image—Mounting Pedestal (Reference) | 21 |
| Top View Image—Mounting Pedestal (Prime) | 21' |
| Top View Image Jewelry—Reference | 22 |
| Front View Image Jewelry—Reference | 23 |
| Side View Image Jewelry—Reference | 24 |
| Top View Image Jewelry—Prime | 22' |
| Front View Image Jewelry—Prime | 23' |
| Side View Image Jewelry—Prime | 24' |
| Final Image—Top View | 25 |
| Final Image—Front View | 26 |
| Final Image—Side View | 27 |

DETAILED DESCRIPTION

Specification

In overview, the apparatus as described herein teaches an apparatus and method which allows an item of jewelry to be positioned for full perspective image viewing. The full perspective images viewed may also be captured and or manipulated in combination with a camera and or computer. As further described in U.S. Pat. No. 6,229,564, herein referenced and incorporated, the combination of camera and computer technology improves the auto-tracing of jewelry for duplication or replication.

In the following description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

As illustrated in FIG. 1, an item of jewelry 17, such as a ring, is placed on the mounting pedestal 7 of the full image jewelry positioner 1. For brevity, the full image jewelry positioner 1 will be referred to simply as the "jewelry fixture". As shown the item of jewelry 17 must be affixed to the mounting pedestal 7 so that the position of the jewelry 17 in relation to the jewelry fixture 1 is constant. In this embodiment, a retractable jewelry holder 16 is illustrated.

Figure 2:
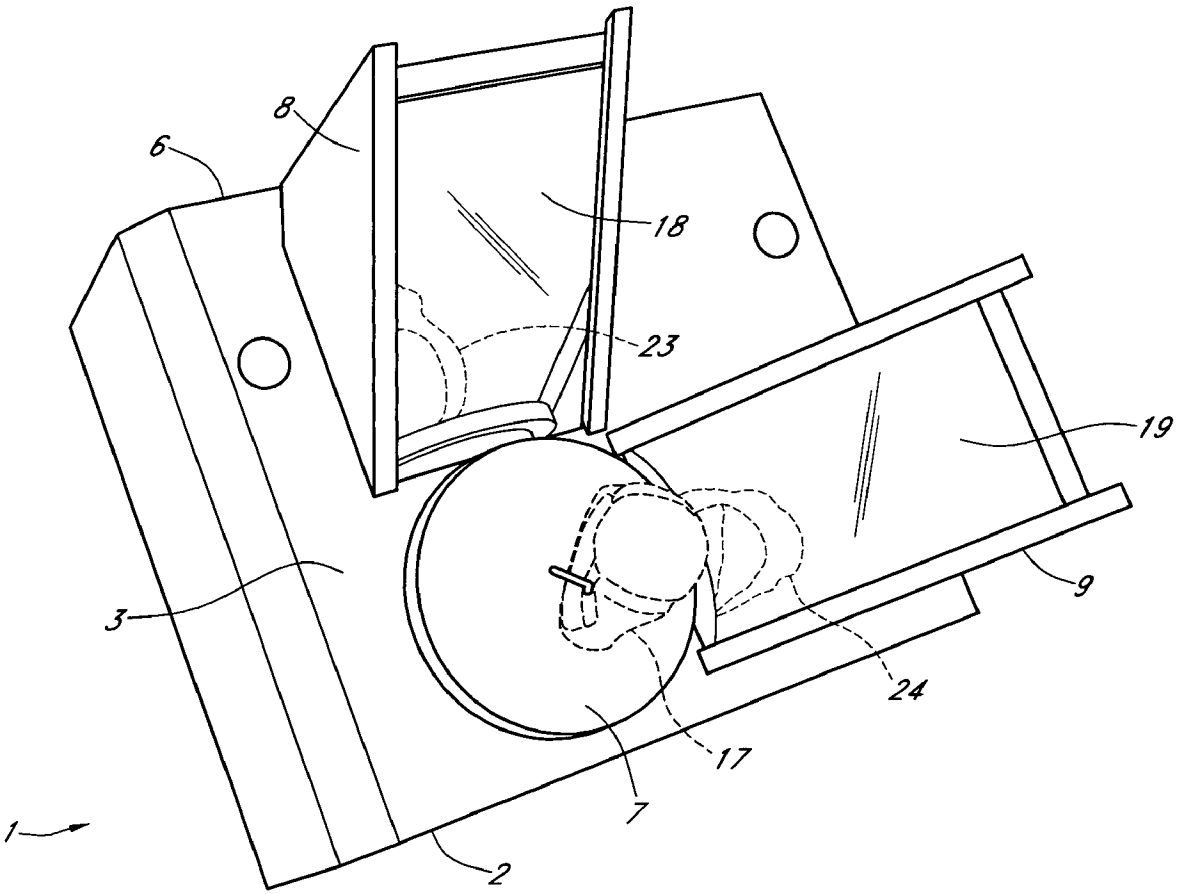
FIG. 2 is a top perspective view of the jewelry fixture.
Figure 3:
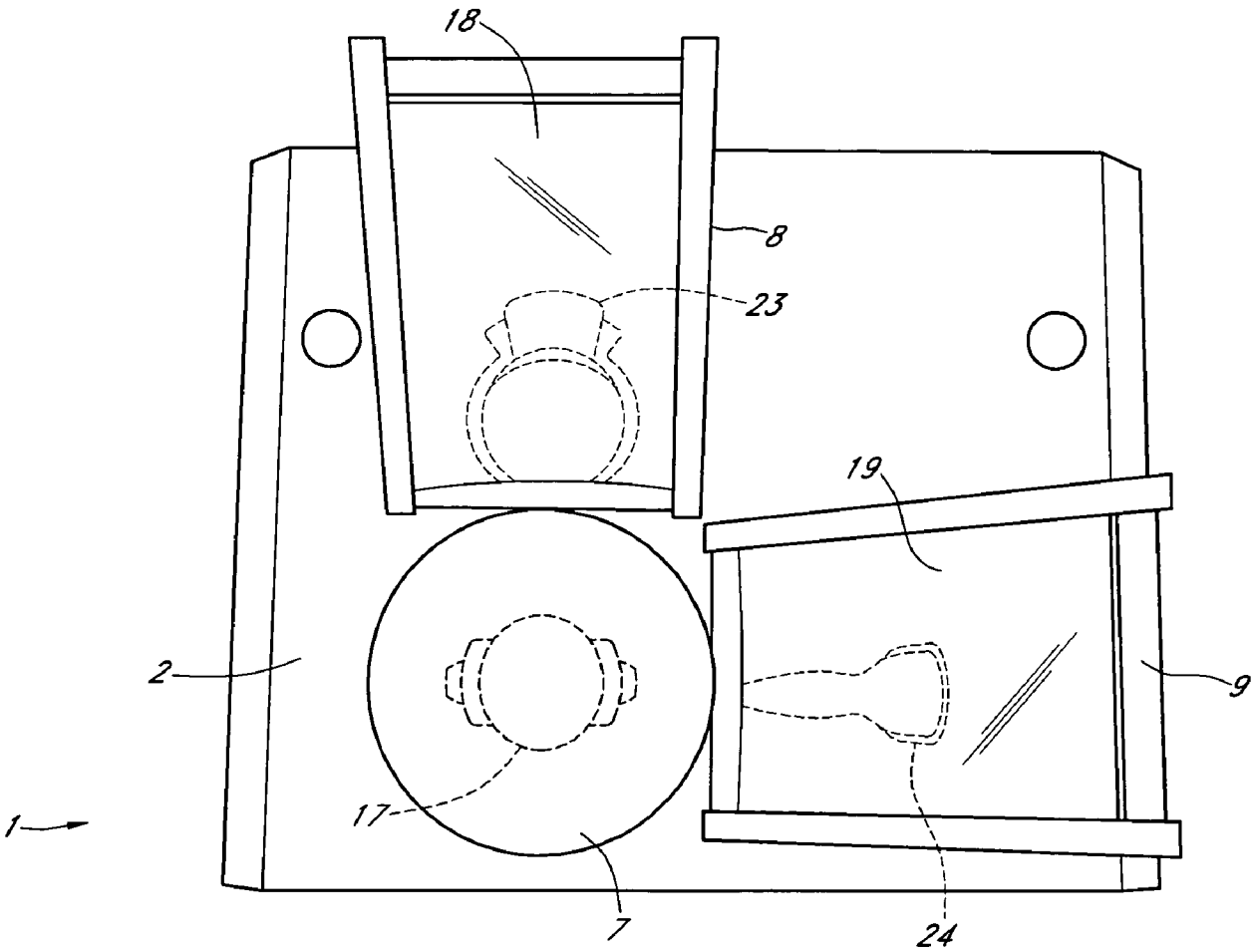
FIG. 3 is a top view of the jewelry fixture.
Figure 5:
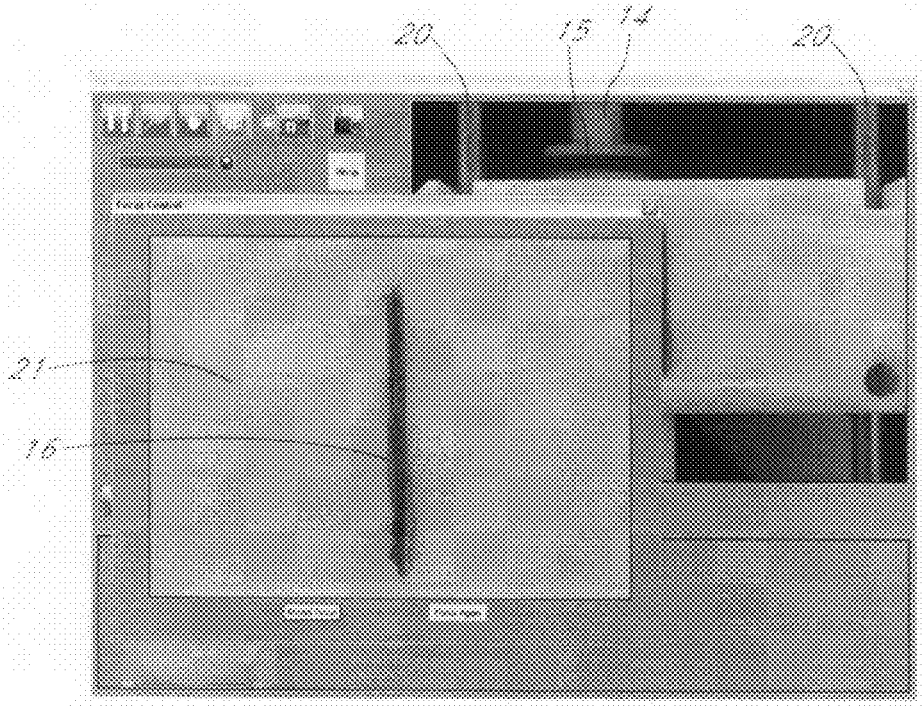
FIG. 5 is another screen print from a computer based camera system using the jewelry fixture with a top view of the mounting pedestal.

The jewelry fixture 1 may then be fixed in place with the camera system. (Not shown) As shown in FIG. 1-3, in one embodiment of the jewelry fixture 1, the reference positioning means are a set of symmetrical holes drilled through the base 2 of the jewelry fixture 1 and labeled first and second reference positioning guides, 10 and 11, respectively. The prime positioning means, in this embodiment, are a set of grooves a set distance from the reference positioning means labeled first and second prime positioning guides, 12 and 13, respectively. Both of the reference and prime positioning means, (10, 11) and (12, 13), respectively, are designed for removable engagement with positioner rods 20, as shown in FIG. 5. The reference and prime positioning guides (10, 11) and (12, 13), respectively, as shown are one means of changing the position of the jewelry fixture 1 in relation to an image capture system, such as a camera or a camera and computer, as recited in the claims.

Those skilled in the arts will also appreciate that although not shown, the positioner rods 20 are to be fixed in relation to a camera when the jewelry fixture 1 is used for image capture. The jewelry fixture 1 is easily detachable from the positioning rods 20 and may be moved between the reference and the prime positions with relative ease. Adjacent the mounting pedestal 7 is a first angled surface support 8 having a first angled surface 18 which is reflective and typically with a mirror or mirror like finish. As shown in FIG. 1, the angled mirrored surface 18 is at a forty-five (45) degree slope away from the vertical in relation to the mounting pedestal 7. A second angled surface support 9 also having an angled mirrored surface 19 is positioned adjacent the pedestal and at a ninety degree angle to the first angled surface support 8 and surface 18. The second angled surface 9 having a mirror finish 19 is also at a forty-five (45) degree slope away from the mounting pedestal 7. The mounting pedestal as shown is one means of fixing or stabilizing the item of jewelry 17 before the first and second angled surfaces as recited in the claims. The positioning rods 20 as shown are one means of fixing or mounting the jewelry fixture, as recited in the claims.

Figure 6:
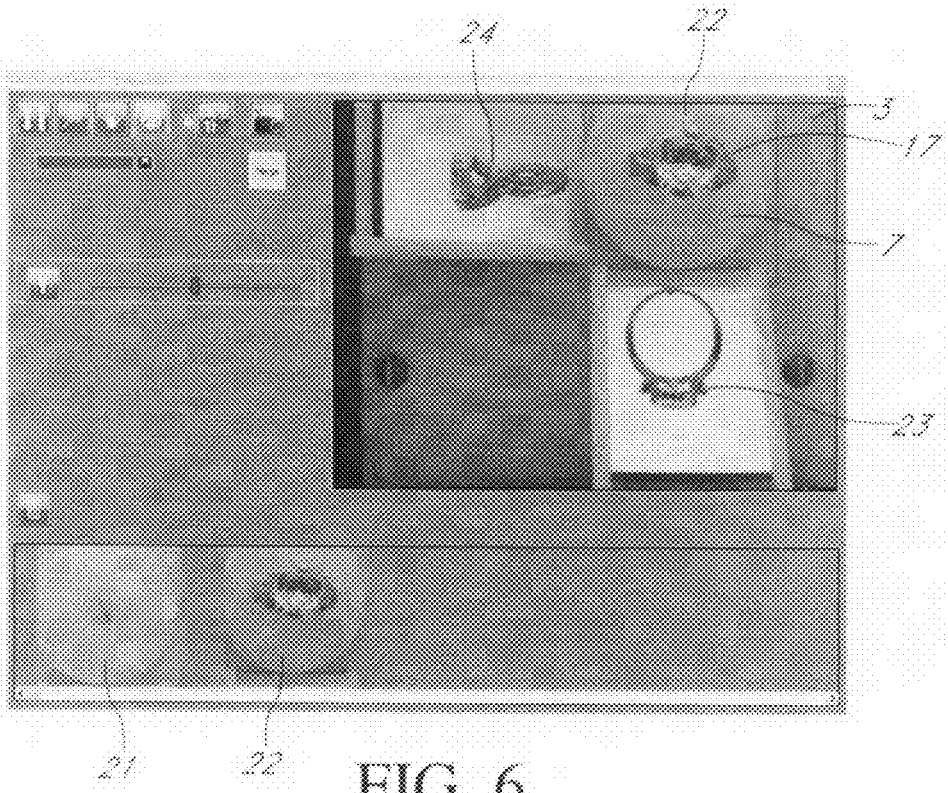
FIG. 6 is a screen print from a computer based camera system using the jewelry fixture with the reference set of images captured.
Figure 7:
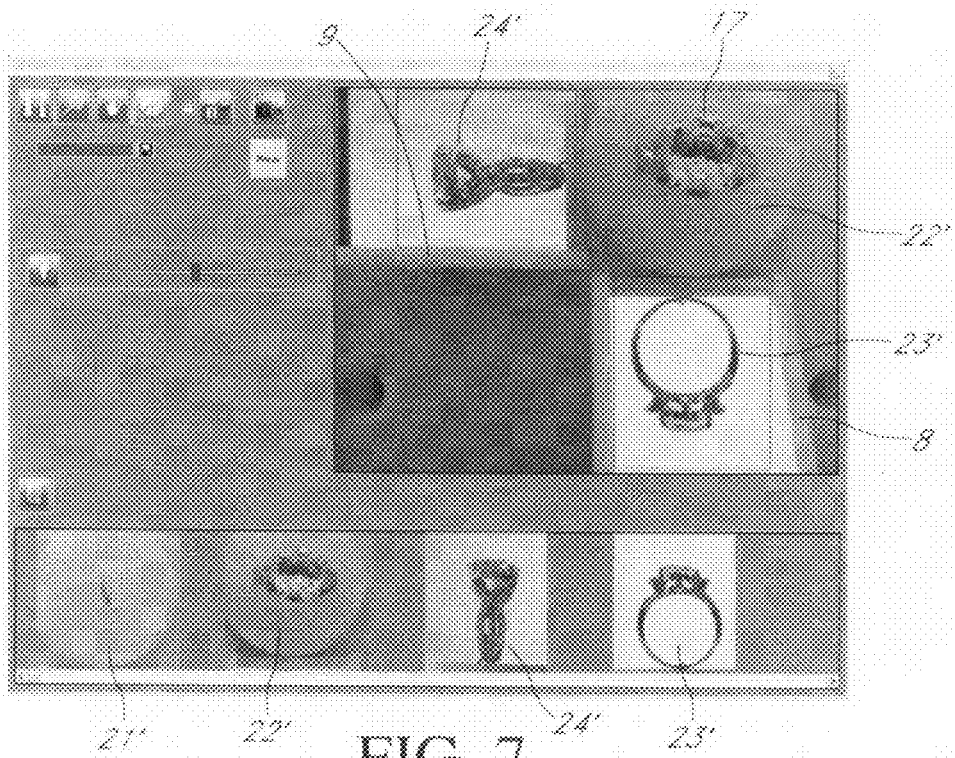
FIG. 7 is a screen print from a computer based camera system using the jewelry fixture with the prime set of images captured; and, FIG. 8 is a screen print from a computer based camera system using the jewelry fixture with the reference and prime image sets captured and combined.
Figure 8:
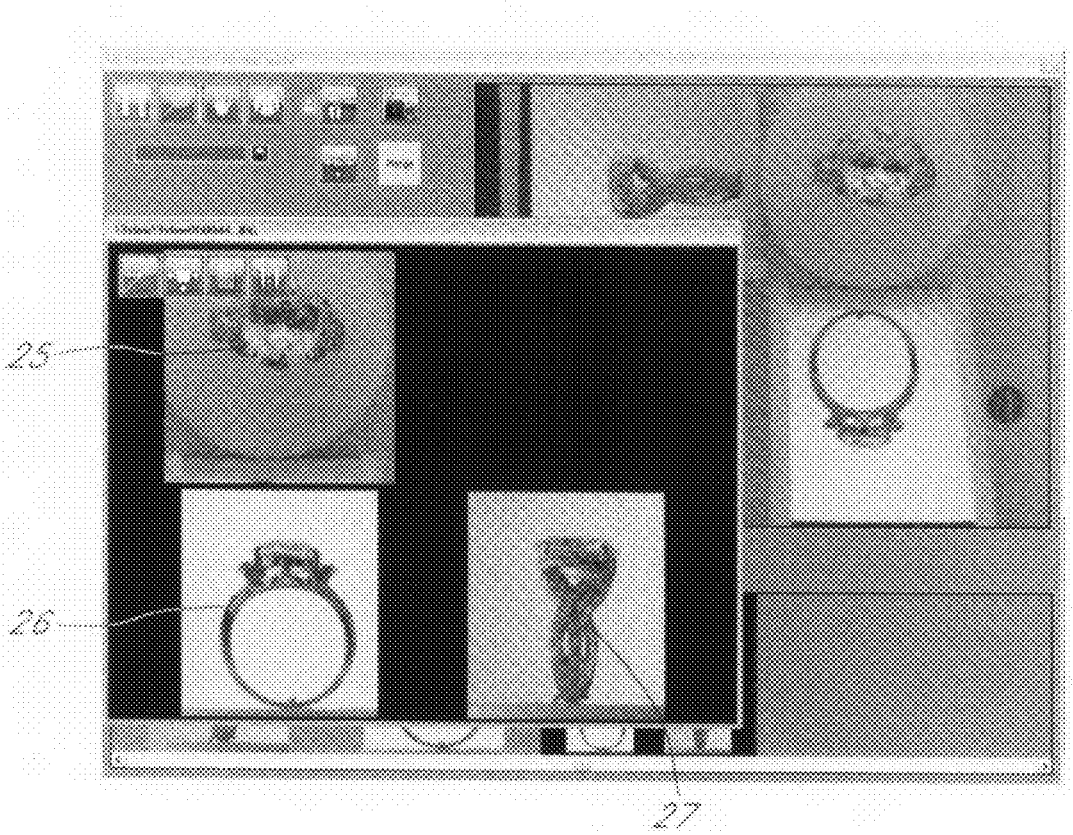

As illustrated in FIG. 2, when an item of jewelry 17, such as a ring, is placed on the mounting pedestal 7 of the jewelry fixture 1, one fixed position allows multiple images illustrated in the FIGS. 3, 6 and 7. FIG. 3, for example, illustrates that the first image 23, as reflected in angled surface 18 provides a front view of the ring positioned on the mounting pedestal 7. Second image 24 as reflected in angled surface 19, provides a side view of the ring positioned on the mounting pedestal 7. FIG. 3 also illustrates this principle by showing a front view of the ring in image 23 in the first angled surface 18 which highlights the details of the gemstone supports while the mirror of the second angled surface 19 captures the details of the ring band in the side view image 24. Those skilled in the arts will grasp the benefit this arrangement provides to a jeweler in attempting to duplicate or replicate the item of jewelry 17 which may have intricate details. FIGS. 6-8 further illustrate the advantage of the present art with screen prints of an actual ring 17 having a detailed underside and gemstone support lattice. As illustrated in FIG. 1-8, the first and second angled mirror surfaces, 18 and 19, surrounding the two sides of the item of jewelry 17 allow for the capture of multiple views of the item of jewelry with a single camera, image capture device and or computer system.

Figure 4:
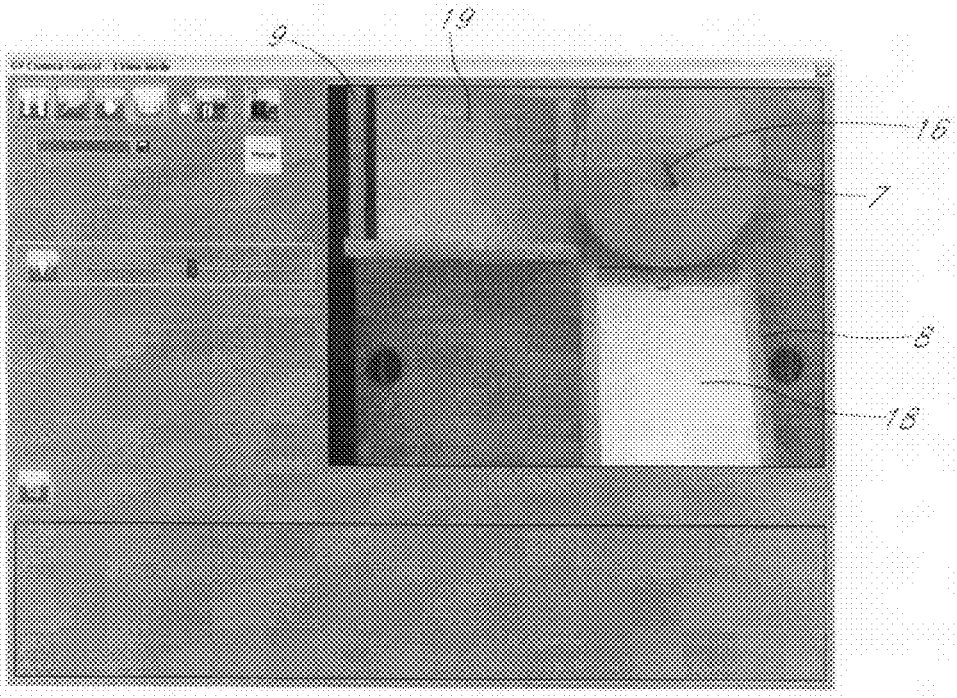
FIG. 4 is a screen print from a computer based camera system using the jewelry fixture.

FIGS. 4-8 illustrate using the images captured by a camera and computer system in combination with the jewelry fixture 1. In FIGS. 4 and 5 the jewelry fixture 1 was placed in the light box for calibration without the item of jewelry 17. Then, as shown in FIGS. 6 and 7, the item of jewelry 17 to be traced or replicated is secured to the jewelry fixture 1 and placed in the lighted box. (See U.S. Pat. No. 6,229,564 for further description and background on the lighted box.) This step allows the camera (not shown) to capture a set of reference images of the item of jewelry 17 which fixes the focal point of the reference images (22, 23, 24) as shown in FIG. 6. After capturing the set of reference images shown in FIG. 6, the user must then capture a set of prime images. The prime images, as illustrated in FIG. 7, change only the relationship between the camera and the item of jewelry 17. The change in relationship may be accomplished by repositioning the object within the light box i.e. changing the distance between the camera and the jewelry piece 17 a known distance, i.e. by disengaging the reference positioning guides (10, 11) from the positioner support rods 20 and engaging the prime positioning guides (12, 13) with positioner support rods 20, thus moving the positioner a known pre-selected distance. FIG. 7 illustrates a set of prime images created by changing the distance of the jewelry fixture 1 from the camera (not shown). FIG. 8 illustrates the final images (25, 26 and 27) of the item of jewelry 17 that may be produced when the reference and prime images are combined.

The user may also produce the images found in FIGS. 6 and 7 by simply changing the focal point of the camera a known distance i.e. having the focal point for the reference images and the prime images also being a known distance apart. The user, through the camera controls or the computer interface, may then determine where the image focal point will be. This step allows the camera (not shown) to capture a set of reference images of the item of jewelry 17 which fixes the focal point of the reference images. Using either method, the spatial relationship between the item of jewelry 17 and the jewelry fixture 1 never changes. As described herein, the jewelry fixture 1 maintains the spatial relationship for the reference and prime image sets.

The present invention may be embodied in other specific forms without departing from the essential attributes thereof. Reference should be made to the appending claims rather than the foregoing specification as indicating the scope of the invention.

What is claimed is:

1. A jewelry fixture comprising:

a. a base, said base having a top side and a bottom side, a front side and a back side, a first and a second side;

b. a mounting pedestal surface cooperatively engaged with said top side of said base and a supporting cylinder, said supporting cylinder is inserted into and through a supporting cylinder tube bored in said base and positioned between said top and bottom sides of said base, wherein the supporting cylinder is rotatable;

c. a first reference positioning guide and a second reference positioning guide, wherein said first and second reference positioning guides extend along the length of said base;

d. first prime positioning guide and a second prime positioning guide, wherein said first and second prime positioning guides are formed as linear channels along the length of said base adjacent said base bottom side;

e. a first angled surface support cooperatively positioned on said top side of said base and having an angled surface wherein said angled surface is reflective;

f. a second angled surface support cooperatively positioned on said top side of said base and also having an angled surface wherein said angled surface is reflective, said second angled surface support positioned adjacent and perpendicular to said first angled surface support; and, g. a jewelry holder allowing cooperative engagement with an item of jewelry, said jewelry holder positioned between said first angled surface support and said second angled surface support and cooperatively engaged with said mounting pedestal on said top side of said base;

wherein, in combination with a camera for the capture of a reference set of images when the jewelry fixture is positioned in relation to the camera using the reference positioning guides and capture of a prime set of images when the jewelry positioning fixture is positioned in relation to the camera using the prime positioning guides, and in combination with a camera and computer system for the capture and manipulation of full perspective images for improved jewelry auto-tracing wherein the camera is selected from the group consisting of film cameras, digital cameras, point and shoot digital cameras, digital video cameras, video tape recording, electronic imaging and combinations thereof;

wherein, said captured reference images and said prime images are communicated to said computer system and combined to produce full perspective images useful in jewelry auto-tracing for improved duplication of said item of jewelry.

2. The jewelry positioning fixture according to claim 1 wherein the first and second angled surfaces are inclined 45 degrees from vertical.

3. The jewelry fixture according to claim 1 wherein the jewelry holder is retractable.

4. The jewelry fixture according to claim 1 wherein the mounting pedestal is rotatable.

5. The jewelry fixture according to claim 4 wherein the jewelry holder is retractable.

6. The jewelry fixture according to claim 1 wherein said top side, said bottom side, said front side, said back side, said first side and said second side generally form a cube-like structure.

7. The jewelry fixture according to claim 1 in combination with a camera for the capture of full perspective images.

8. A jewelry positioning fixture comprising:

a. a base means;

b. a mounting pedestal means engaged with said base means;

c. a reference positioning means;

d. a prime positioning means;

e. a first angled surface cooperatively positioned on said base means wherein said angled surface is a mirror;

f. a second angled surface cooperatively positioned on said base means wherein said angled surface is a mirror and said second angled surface is positioned adjacent and perpendicular to said first angled surface;

g. a jewelry holding means positioned between said first angled surface and said second angled surface on said base means;

h. a camera and computer system for the capture and manipulation of full perspective images for improved jewelry auto-tracing wherein the camera is selected from the group consisting of film cameras, digital cameras, point and shoot digital cameras, digital video cameras, video tape recording, electronic imaging and combinations thereof, wherein the camera may be used for the capture of a reference set of images when the jewelry positioning fixture is positioned in relation to the camera using the reference positioning means and capture of a prime set of images when the jewelry positioning fixture is positioned in relation to the camera using the prime positioning means, and wherein said captured reference images and said prime images are communicated to said computer system and combined to produce full perspective images useful in jewelry auto-tracing for improved duplication of said item of jewelry.

* * * * *